United States Patent [19]

Buxbaum et al.

[11] Patent Number: 4,877,420

[45] Date of Patent: Oct. 31, 1989

[54] HALOGEN-CONTAINING FILLERS FOR ABRASIVE BODIES, IN PARTICULAR FOR GRINDING WHEELS OR CUTTING WHEELS, TO A PROCESS FOR THE PRODUCTION OF THESE FILLERS AND TO ABRASIVE BODIES CONTAINING THEM

[75] Inventors: Lother Buxbaum, Landskron; Helmut Stessel, Arnoldstein, both of Austria

[73] Assignee: BBU-Chemie Gesellschaft m.b.H, Arnoldstein, Austria

[21] Appl. No.: 219,549

[22] Filed: Jul. 14, 1988

[30] Foreign Application Priority Data

Jul. 17, 1987 [AT] Austria ..... 1810/87

[51] Int. Cl.[4] ..... C09C 1/02

[52] U.S. Cl. ..... 51/309; 51/293; 51/298

[58] Field of Search ..... 51/293, 298, 309

[56] References Cited

U.S. PATENT DOCUMENTS

| | | | |
|---|---|---|---|
| 2,216,135 | 10/1940 | Rainier | 51/298 |
| 4,263,016 | 4/1981 | Hirschberg et al. | 51/309 |
| 4,500,325 | 2/1985 | Huber et al. | 51/298 |

FOREIGN PATENT DOCUMENTS

| | | |
|---|---|---|
| 372894 | 7/1981 | Austria . |
| 3441596 | 11/1984 | Fed. Rep. of Germany . |

*Primary Examiner*—A. Lionel Clingman
*Assistant Examiner*—Willie J. Thompson
*Attorney, Agent, or Firm*—Seidel, Gonda, Lavorgna & Monaco

[57] ABSTRACT

Proposed is a halogen-containing filler for abrasive bodies on the basis of at least one metal halide or metal complex salt of the formula $$A_xMe_y^{II}Me_z^{III}Hal_E.nB_fC_gHal_e.mH_2O.oNH_3$$

wherein
A: is an alkali metal or ammonium,
x: a number of 0 to 10,
$Me^{II}$: Mn, C, Mg, Zn, Sn, Cu, Co or Ni,
y: a number of 0 to 2,
$Me^{III}$: Al, B or Ti,
z: a number of 0 to 2,
Hal: a halogen,
E: a number of 1 to 10,
n: a number of 0 to 10,
B: an alkali metal or ammonium,
f: a number of 0 to 1,
C: Ca, Mg, Zn, Sn or Mn,
g: a number of 0 to 1,
e: a number of 1 to 2,
m: a number of 0 to 10 and
o: a number of 0 to 10, and/or at least one alkali chloroferrate (II,III) of the formula $$A_xFe_y^{++}Fe_z^{+++}Cl_{x+2y+3z}$$

wherein A represents an alkali metal or ammonium, x stands for a number of 1 to 10, y is a number of zero to 1 and z is a number from zero to 1 and y and z are not simultaneously zero, the ferrate preferably being formed in combination with a basic inorganic compound such as zinc oxide, potassium carbonate or sodium sulfide, and/or at least one mixture of a basic aluminum chloride with NaCl and/or KCl, which is characterized above all in that it contains at least one fluorine compound, in particular at least one fluoride, and/or at least one salt of an oxygen acid of nitrogen, phosphorus and/or sulfur; an abrasive body, in particlar for metals, which contains this filler, said body containing an abrasive, a binder as well as said active, halogen-containing filler, optionally in addition to other fillers, as well as a process for the production of said filler.

22 Claims, No Drawings

HALOGEN-CONTAINING FILLERS FOR ABRASIVE BODIES, IN PARTICULAR FOR GRINDING WHEELS OR CUTTING WHEELS, TO A PROCESS FOR THE PRODUCTION OF THESE FILLERS AND TO ABRASIVE BODIES CONTAINING THEM

The present invention relates to halogen-containing fillers for abrasive bodies, in particular for grinding wheels or cutting wheels, to a process for the production of these fillers and to abrasive bodies containing them.

Abrasive bodies, for instance cutting wheels, consist mainly of three components, namely, the abrasive, granular grinding agent, a binder and fillers. So-called active fillers (grinding aid fillers) have become known for absorbing and evacuating the frictional heat generated in grinding, for reducding the friction between abrasive body and workpiece and for forming protective layers on abrasive grain, workpiece and chips.

Among the large number of compounds used as active fillers, metal halides and complex metal halogens (containing several metals) are particularly common. So, for instance, Austrian Patent 372 894 relates to such halides or complex halides of the formula $$A_xMe_y^{II}Me_z^{III}Hal_E.nB_fC_gHal_e.mH_2O.oNH_3$$

wherein

A: is an alkali metal or ammonium,
x: a number of 0 to 10,
$Me^{II}$: Mn, Ca, Mg, Zn, Sn, Cu, Co or Ni,
y: a numer of 0 to 2,
$Me^{III}$: Al, B or Ti,
z: a number of 0 to 2,
Hal: a halogen,
E: a number of 1 to 10,
n: a number of 0 to 10,
B: an alkali metal or ammonium,
f: a number of 0 to 1,
C: Ca, Mg, Zn, Sn or Mn,
g: a number of 0 to 1,
e: a number of 1 to 2,
m: a number of 0 to 10 and
o: a number of 0 to 10, with manganese chloride, complex manganese chlorides and complex stannic chlorides each containing $NH_4$ or K in addition to manganese or tin being mentioned as examples. U.S. Pat. No. 2,216,135 proposes anhydrous, water-soluble, non-oxidizing inorganic alkali metal or alkaline earth metal salts with melting points within the range of 700° to 1200° C. for this purpose, chlorides and bromides being mentioned as suitable halides. European Pat. No. 8 697 describes alkali chloroferrates (II,III) of the formula $$A_xFe_y^{++}Fe_z^{+++}Cl_{x+2y+3z}$$

in this context, wherein A represents an alkali metal or ammonium, x stands for a number of 1 to 10, y is a number of zero to 1 and z is a number of zero to 1 and y and z are not simultaneously zero, the ferrate preferably being formed in combination with a basic inorganic compound, for instance zinc oxide, potassium carbonate or sodium sulfide, which may also be used in mixtures with KCl or NaCl, while German application No. 34 41 596 discloses mixtures of basic aluminum chloride and KCl and/or NaCl.

An essential drawback of the halides used up to now as active fillers is the fact that they are always hygroscopic to a certain extent. This causes, a.o., that they strongly react with the resol resins (phenol resins) normally used as binders, so that the abrasive bodies have lower and uneven strength. This further causes a greasy body surface impairing the grinding effect and corrosion phenomena in machines and workpieces.

This drawback had already been recognized and Austrian Pat. No. 372 894 discloses that the special metal halides proposed in there are to have very low hygroscopicity.

It was now surprisingly found that the properties of the halogen-containing active fillers according to Austrian Pat. No. 372 894, European Patent appl. No. 8 697 and/or German Patent application No. 34 41 596 can be vastly improved by using them together with at least one fluorine compound, in particular at least one fluoride, and/or at least one salt of an oxygen acid of nitrogen, phosphorus and/or sulfur.

Accordingly, the halogen-containing filler according to the invention is mainly characterized in that it contains at least one fluorine compound, in particular at least one fluoride, and/or at least one salt of an oxygen acid of nitrogen, phosphorus or sulfur.

According to a further characterizing feature, this content amounts to 1 to 40, preferably 3 to 20, percent by weight based on the filler.

The various oxygen acids of nitrogen, phosphorus and sulfur are described, for instance, in Hollemann-Wiberg, Lehrbuch der anorganischen Chemie, 81st to 90th edition, pages 401 to 413, 444 to 461 and 328 to 350, the discloure thereof being incorporated herein by reference.

Suitable cations of the fluorides or salts of the oxygen acids mentioned are $NH_4$, the alkali and alkaline earth metals as well as Al, B, Co, Cu, Fe, Mn, Ni, Sn, Ti and Zn, the simplest examples of the oxygen acid salts being nitrates, phosphates and sulfates, for instance $Ca(NO_3)_2$.

Suitable fluorine compounds, in addition to the preferred fluorides, are fluorosulfates, fluorophosphates, fluoroaluminates and fluoroborates.

The fluorine compounds, in particular fluorides, and/or salts of the oxygen acids of nitrogen, phosphorus and/or sulfur, can be simply added, as e.g. described in European Patent application No. 8 697, to the known halogen-containing active fillers which may—for instance if they are complex salts—also contain an excess of alkali chloride (e.g. 15 mol percent); conveniently, however, they are added during the production of the halogen-containing fillers themselves, these additives are added to the starting products, for instance, either in the melt or in solution and the composition thus obtained is processed in a manner known per se to a finely divided powder.

The additives according to the invention can be used individually or as a mixtures of several of these substances.

By the addition of basic inorganic compounds such as zinc oxide, alkali carbonate or sodium sulfide, the pH value can be adjusted so as to obtain a largely neutral product, for instance in the case of complex salts in amounts of 2 to 20 percent by weight based on the complex salt.

The abrasive bodies, in particular grinding wheels, according to the invention contain, as already mentioned, an abrasive, granular grinding agent, a binder, conventionally mainly phenol resins, and a halogen-containing, active filler—optionally in addition to other fillers—and are mainly characterized in that the halogen-containing filler additionally contains at least one fluorine compound, in particular at least one fluoride, and/or at least one salt of an oxygen acid of nitrogen, phosphorus and/or sulfur.

According to a further characterizing feature, this content amounts to 1 and 40 percent by weight, preferably 3 to 20 percent by weight, based on the halogen-containing filler.

The percentage of the halogen-containing filler modified according to the invention, in particular on the basis of a metal complex halide, amounts to at least 5 percent by weight based on the total amount of filler.

In addition to inorganic halogen compounds such alkali and alkaline earth metal chlorides, organic halogen compounds such as chlorine and/or bromine compounds can be added to the halogen-containing filler modified according to the invention.

The use of K and Na sulfate and K and Na pyrosulfate as well as magnesium sulfate as such an addition to abrasive bodies is known from U.S. Pat. No. 2,216,135, but not in combination with halogen-containing, active fillers.

The grinding wheels according to the invention are produced in a manner known per se—for instance by mixing of the components, press forming and hardening—and show good cut qualitites (white cut) and high cutting output. Due to the virtually eliminated hygroscopicity of the filler, the grinding wheels harden more uniformely, there is less breakage of grinding wheels. The surfaces of the grinding wheels stored in humid climates remain dry.

The invention is explained in the following by means of some exemplary embodiments describing the modification of halogen-containing metal complex salts according to the invention.

EXAMPLE 1

(1.1) Production of the complex salt 738.4 g of KCl and 490 g of $MnCl_2.4H_2O$ were melted in the graphite crucible at 700° C. When the release of gas bubbles had stopped, the melt was kept for a further 30 minutes at 700° C., then poured into a cast iron mold and the substance obtained after one hours of cooling was precrushed in a jaw breaker and subsequently ground.

The complex salt obtained, its batch being calculated for the production of $K_4MnCl_6$(or $K_2MnCl_4.2KCl$), consists to at least 50 percent of this compound; further contained are other complex compounds, above all $K_3MnCl_5$, $K_2MnCl_4$ as well as $KMnCl_3$, and free potassium chloride. This is a phenomenon which appears, a.o., in the complexes of prior art because it is typical for compounds of this type.

(1.2) Modification of the complex salt

Prior to melting, 10 percent by weight each of modification agent based on the batch (1.1) were added to the batch (1.1) and the batch was processed as indicated under (1.1).

The results obtained are summarized in the following table:

TABLE 1

| | | water absorption in % |
|---|---|---|
| complex salt | | 50.7 |
| complex salt modified by | Na—polyphosphate | 18.50 |
| | Na—metaphosphate | 14.33 |
| | Maddrell's salt | 13.85 |
| | $Na_2HPO_4$ | 11.05 |
| | $NaHSO_4$ | 27.53 |
| | mono-Na—phosphate | 33.10 |
| | tri-K—phosphate | 33.98 |
| | K—tripolyphosphate | 35.00 |
| | di-K—phosphate | 35.05 |
| | mono-K—phosphate | 35.53 |
| | $K_4P_2O_7$ | 34.00 |
| | Ca—pyrophosphate | 39.78 |
| | mono-Mg—phosphate | 40.03 |
| | mono-Zn—phosphate | 40.30 |
| | Zn—pyrophosphate | 41.85 |
| | tert-Zn—phosphate | 41.83 |
| | $(KPO_3)_n$ | 34.65 |
| | NaF | 0.35 |
| | potassium fluoride | 25.85 |
| | $KPF_6$ | 34.00 |
| | $Na_2SO_4$ | 9.63 |
| | $KHSO_4$ | 29.50 |
| | K—disulfate | 37.80 |
| | $K_2SO_4$ | 38.15 |
| | $KAl(SO_4)_2$ | 43.85 |
| | $CaF_2$ | 45.20 |
| | $CaSO_4$ | 46.03 |

EXAMPLE 2

(2.1) Production of the complex salt 340.8 g of $ZnCl_2$ were mixed with 745.5 g of KCl and melted in the graphite crucible at 700° C. The melt was kept at 700° C. for 30 minutes and then further processed as indicated in 1.1).

(2.2) Modification of the complex salt

Each 10 percent by weight of modification agent based on the batch (2.1) were added to the batch (2.1) prior to melting and the batch was processed as indicated in (2.1).

The results obtained are summarized in the following table:

TABLE 2

| | | water absorption in % |
|---|---|---|
| complex salt | | 17.4 |
| modified by means of | $Na_2SO_4$ | 8.4 |
| | $Na_2HPO_4$ | 0.28 |
| | Na metaphosphate | 12.7 |
| | Na polyphosphate | 13.6 |
| | Maddrell's salt | 15.3 |
| | NaF | 15.9 |

EXAMPLE 3

(3.1) Production of the complex salt 298.2 g KCl and 134.5 g $CuCl_2$ were melted in the graphite crucible at 500° C. The melt was kept at 500° C. for 30 minutes and further processed according to (1.1).

| | % $H_2O$ absorption |
|---|---|
| complex salt | 9.1 |

(3.2) Modification of the complex salt by means of $Na_2SO_4$ 10 and 30 percent of $Na_2SO_4$ were added to the batch (3.1) prior to melting and the batch was further processed as indicated under (2.1).

| | % $H_2O$ absorption |
|---|---|
| complex salt with 10% $Na_2SO_4$ | 5.1 |
| complex salt with 30% $Na_2SO_4$ | 0.5 |

(3.3) Modification of the complex salt with $K_2SO_4$ 10 and 30% of $K_2SO_4$ were added to the batch (3.1) prior to melting and the batch was further processed as indicated under (2.1).

| | % $H_2O$ absorption |
|---|---|
| complex salt with 10% $K_2SO_4$ | 6.7 |
| complex salt with 30% $K_2SO_4$ | 0.9 |

In the examples, the water absorption is determined as follows in each case: The samples were sifted and 2 g each of the fraction of each fraction were evenly spread less than 125 u on a crystallization dish. The dishes were stored in a container at 65 percent of relative humidity and the increase in weight was determined after 100 hours in each case.

It is evident that by the modification according to the invention, the water absorption of the haogen-containing, active additives can be essentially reduced.

We claim:

1. A halogen-containing filler for abrasive bodies comprising:

(a) at least one halogen-containing member selected from the group consisting of:

(1) metal halides or metal complex salts of the formula $$A_xMe_y^{II}Me_z^{III}Hal_E.nB_fC_gHal_e.mH_2O.oNH_3$$

wherein
A is an alkali metal or ammonium,
x is a number from 0 to 10,
$Me^{II}$ is Mn, Ca, Mg, Zn, Sn, Cu, Co or Ni,
y is a number from 0 to 2,
$Me^{III}$ is Al, B or Ti,
z is a number from 0 to 2,
Hal is a halogen,
E is a number from 1 to 10,
n is a number from 0 to 10,
B is an lkali metal or ammonium,
f is a number from 0 to 1,
C is Ca, Mg, Zn, Sn or Mn,
g is a number from 0 to 1,
e is a number from 1 to 2,
m is a number from 0 to 10 and
o is a number from 0 to 10;

(2) alkali chloroferrates of the formula $$A_xFe_y^{++}Fe_z^{+++}Cl_{x+2y+3z}$$

wherein
A is an alkali metal or ammonium,
x is a number from 1 to 10,
y is a number from zero to 1,
z is a number from zero to 1, with the proviso that y and z cannot be zero at the same time; and (3) mixtures of a basic aluminum chloride and at least one chloride selected from the group consisting of NaCl and KCl; and (b) at least one additive compound selected from the group consisting of:

(1) fluorine compounds, and (2) salts of an oxygen acid selected from the group consisting of the oxygen acids of nitrogen, phosphorous, sulfur and combinations thereof.

2. A filler according to claim 1 wherein the additive compound contains a cation selected from the group consisting of ammonium, alkali metals, alkaline earth metals, Al, B, Co, Cu, Fe, Mn, Ni, Sn, Ti and Zn.

3. A filler according to claim 1 wherein the additive compound is a fluorine compound selected from the group consisting of fluorides, fluorosulfates, fluorophosphates, fluoroaluminates, fluoroborates and combinations thereof.

4. A filler according to claim 1 wherein the additive compound comprises from about 1% to about 40% by weight of the filler.

5. A filler according to claim 4 wherein the additive compound comprises from about 3% to about 20% by weight of the filler.

6. A filler according to claim 1 containing an alkali chloroferrate of the formula $$A_xFe_y^{++}Fe_z^{+++}Cl_{x+2y+3z}$$

wherein
A is an alkali metal or ammonium,
x is a number from 1 t 10,
y is a number from zero to 1,
z is a number from zero to 1, with the proviso that y and z cannot be zero at the same time, said alkali chloroferrate having been formed in combination with a basic inorganic compound.

7. A filler according to claim 6 wherein the basic inorganic compound is selected from the group consisting of zinc oxide, potassium carbonate and sodium sulfide.

8. An abrasive body comprising:

(a) an abrasive;

(b) a binder; and (c) a halogen-containing filler according to claim 1.

9. An abrasive body according to claim 8 wherein the additive compound of the halogen-containing filler contains a cation selected from the group consisting of ammonium, alkali metals, alkaline earth metals, Al, B, Co, Cu, Fe, Mn, Ni, Sn, Ti and Zn.

10. An abrasive body according to claim 8 wherein the additive compound of the halogen-containing filler is a fluorine compound selected from the group consisting of fluorides, fluorosulfates, fluorophosphates, fluoraluminates, fluoroborates and combinations thereof.

11. An abrasive body according to claim 8 wherein the additive compound comprises from about 1% to about 40% by weight of the halogen-containing filler.

12. An abrasive body according to claim 11 wherein the additive compound comprises from about 3% to about 20% by weight of the halogen-containing filler.

13. An abrasive body according to claim 8 containing a filler wherein at least 5% by weight of said filler comprises the halogen-containing filler.

14. An abrasive body according to claim 8 wherein the halogen-containing filler contains an alkali chloroferrate of the formula $$A_xFe_y^{++}Fe_z^{+++}Cl_{x+2y+3z}$$

wherein

A is an alkali metal or ammonium, x is a number from 1 t 10, y is a number from zero to 1, z is a number from zero to 1, with the proviso that y and z cannot be zero at the same time, said alkali chloroferrate having been formed in combination with a basic inorganic compound.

15. An abrasive body according to claim 14 wherein the basic inorganic compound is selected from the group consisting of zinc oxide, potassium carbonate and sodium sulfide.

16. A process for preparing an active halogen-containing filler for abrasive bodies comprising combining (a) at least one halogen-containing member selected from the group consisting of:

(1) metal halides or metal complex salts of the formula $$A_xMe_y^{II}Me_z^{III}Hal_E.nB_fC_gHal_e.mH_2O.oNH_3$$

wherein

A is an alkali metal or ammonium, x is a number from 0 to 10, $Me^{II}$ is Mn, Ca, Mg, Zn, Sn, Cu, Co or Ni, y is a number from 0 to 2, $Me^{III}$ is Al, B or Ti, z is a number from 0 to 2, Hal is a halogen, E is a number from 1 to 10, n is a number from 0 to 10, B is an alkali metal or ammonium, f is a number from 0 to 1, C is Ca, Mg, Zn, Sn or Mn, g is a number from 0 to 1, e is a number from 1 to 2, m is a number from 0 to 10 and o is a number from 0 to 10;

(2) alkali chloroferrates of the formula $$A_xFe_y^{++}Fe_z^{+++}Cl_{x+2y+3z}$$

wherein

A is an alkali metal or ammonium, x is a number from 1 to 10, y is a number from zero to 1, z is a number from zero to 1, with the proviso that y and z cannot be zero at the same time; and (3) mixtures of a basic aluminum chloride and at least one chloride selected from the group consisting of NaCl and KCl; and (b) at least one additive compound selected from the group consisting of:

(1) fluorine compounds, and (2) salts of an oxygen acid selected from the group consisting of the oxygen acids of nitrogen, phosphorous, sulfur and combinations thereof.

17. A process according to claim 16 wherein the additive compound contains a cation selected from the group consisting of ammonium, alkali metals, alkaline earth metals, Al, B, Co, Cu, Fe, Mn, Ni, Sn, Ti and Zn.

18. A process according to claim 16 wherein the additive compound is a fluorine compound selected from the group consisting of fluorides, fluorosulfates, fluorophosphates, fluoroaluminates, fluoroborates and combinations thereof.

19. A process according to claim 16 wherein the additive compound comprises from about 1% to about 40% by weight weight of the filler.

20. A process according to claim 19 wherein the additive compound comprises from about 3% to about 20% by weight of the filler.

21. A process according to claim 16 wherein the halogen-containing filler contains an alkali chloroferrate of the formula $$A_xFe_y^{++}Fe_z^{+++}Cl_{x+2y+3z}$$

wherein

A is an alkali metal or ammonium, x is a number from 1 t 10, y is a number from zero to 1, z is a number from zero to 1, with the proviso that y and z cannot be zero at the same time, said alkali chloroferrate having been formed in combination with a basic inorganic compound.

22. A process according to claim 21 wherein the basic inorganic compond is selected from the group consisting of zinc oxide, potassium carbonate and sodium sulfide.

* * * * *